US006284444B1

(12) United States Patent
Twist

(10) Patent No.: US 6,284,444 B1
(45) Date of Patent: Sep. 4, 2001

(54) PROCESSING PHOTOGRAPHIC MATERIALS AND PROCESSING SYSTEM THEREFOR

(75) Inventor: Peter J. Twist, Bucks (GB)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/622,637

(22) PCT Filed: Dec. 14, 1999

(86) PCT No.: PCT/GB99/04251

§ 371 Date: Aug. 18, 2000

§ 102(e) Date: Aug. 18, 2000

(87) PCT Pub. No.: WO00/39637

PCT Pub. Date: Jul. 6, 2000

(30) Foreign Application Priority Data

Dec. 23, 1998 (GB) ..... 9828309

(51) Int. Cl.[7] ..... G03C 7/46

(52) U.S. Cl. ..... 430/428; 430/432; 430/463; 430/933

(58) Field of Search ..... 430/428, 432, 430/463, 933

(56) References Cited

U.S. PATENT DOCUMENTS 5,006,456 * 4/1991 Morigaki et al. ..... 430/463
5,009,983 * 4/1991 Abe ..... 430/372
5,236,804 * 8/1993 Tanaka et al. ..... 430/220
6,174,658 * 1/2001 Yamazaki ..... 430/933

FOREIGN PATENT DOCUMENTS

549175 * 6/1973 (EP) .

* cited by examiner

*Primary Examiner*—Hoa Van Le

(57) ABSTRACT

A process for the processing of an imagewise exposed photographic material which has been subjected to development and bleach-fixing comprises a plurality of sequential washing steps and where a stain reducing agent is employed wherein the photographic material is contacted with an effective amount of the stain reducing agent in the wash liquid in a first washing step and the photographic material is subjected to a following washing step to remove the stain reducing agent. The process may employ a plurality of wash tanks in which the developed material is washed sequentially and the stain reducing agent is present in the wash liquid in a first wash tank and removed from the photographic material by the wash liquid in one or more following wash tanks. The temperature of wash liquids in the tanks is preferably within the range 40 to 70° C., preferably 45 to 65° C.

The invention includes a photoprocessor system for the processing of photographic materials for example film or paper comprising: a development tank associated with a bleach-fix tank which is associated with a first of a plurality of wash tanks connected in series and wherein there is provided a reservoir for a stain reducing agent and means for supplying the stain reducing agent to the first wash tank.

7 Claims, 1 Drawing Sheet

PROCESSING PHOTOGRAPHIC MATERIALS AND PROCESSING SYSTEM THEREFOR

FIELD OF THE INVENTION

This invention relates to the processing of photographic materials and to a processing system therefor.

BACKGROUND OF THE INVENTION

In the processing of photographic materials such as paper and film it has sometimes been found that a stain appears in the developed material. The staining is due primarily to retained sensitising dye. The risk of a staining is greater in the case of rapid processes which have been developed employing short cycle times and in which the durations of the individual stages of development, bleach-fix and wash are correspondingly short.

PROBLEM TO BE SOLVED BY THE INVENTION

Certain chemical compounds, known in the art as stain reducing agents, have been previously used for reducing staining and it has been proposed to add a stain reducing agent to the developer liquid. However it has been found that when a short wash time is employed, for example about 15 seconds, that a stain is produced on the developed material. The inventor of the present invention has found that when the concentration of stain reducing agent in the developer solution is increased, the stain is initially reduced but after about 4 weeks is found to increase substantially. Furthermore, they have found that stain reducing agents are not very soluble in the developer solution and tend to precipitate. The stain reducing agent can be added to the bleach-fix solution with the effect that the stain is reduced but here the stain reducing agent is even more prone to precipitate than in the developer. If the stain reducing agent is added to wash water or stabiliser-replenisher it is soluble to a high degree and prevents stain initially but is present in the entire wash and thus retained in the photographic material.

A solution to this problem has now been invented in which the stain reducing agent is added to the first wash or stabiliser tank only and not to subsequent wash or stabiliser tanks. Stain reducing agent is more soluble in this solution than in the developer or bleach-fix and hence the amount in solution is enough to prevent staining. In a preferred embodiment of the invention the wash or stabiliser tanks are run at elevated temperature sufficient to remove the stain reducing agent from the photographic material.

SUMMARY OF THE INVENTION

According to the present invention there is provided a process for the processing of an imagewise exposed photographic material which has been subjected to development and bleach-fixing which process comprises a plurality of sequential washing steps and where a stain reducing agent is employed wherein the photographic material is contacted with an effective amount of the stain reducing agent in the wash liquid in a first washing step and the photographic material is subjected to a following washing step to remove the stain reducing agent.

ADVANTAGEOUS EFFECT OF THE INVENTION

The advantage of the invention is that staining is kept to a low level.

DETAILED DESCRIPTION OF THE INVENTION

Figure 1:
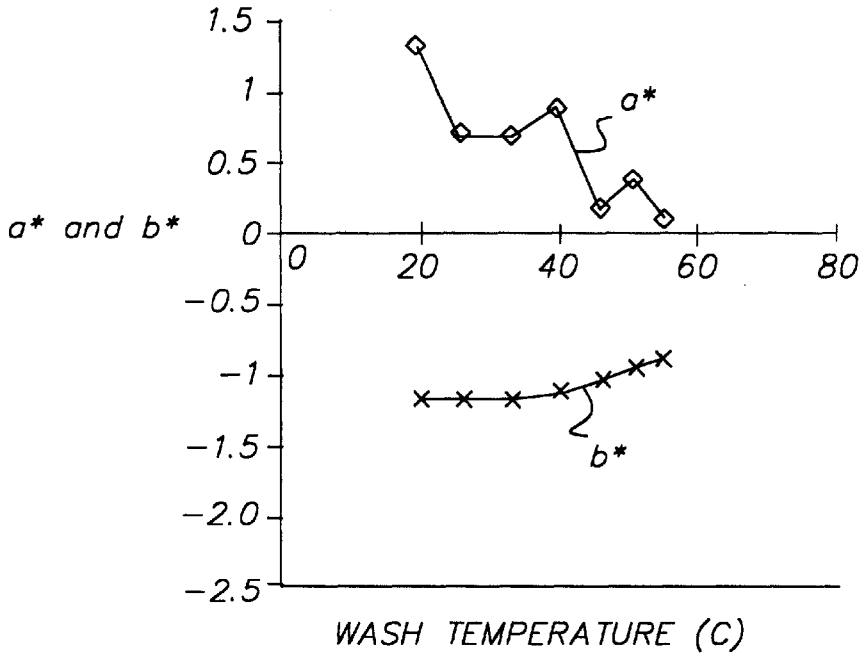
FIG. 1 shows the effect on stain level of an increase in the wash temperature.

References to a wash liquid being free of stain reducing agent mean that no stain reducing agent is present apart from that which may be carried over by the photographic material from the previous tank.

The term wash liquid is intended to include stabilising liquid. The invention is particularly applicable to rapid processing using short cycle times and correspondingly short individual steps.

The invention is suitable for use in small photoprocessors which have become known as minilabs. These usually have a total of four wash or stabiliser tanks. When such a processor is employed the stain reducing agent will normally be added to the wash liquid in the first tank only and the wash liquid in subsequent tanks will be free of stain reducing agent apart from contamination by carry over. The stain reducing agent will select from those that remove sensitising dye and are removable by water washing so that neither are retained in the developed photographic material. Suitable agents include those containing a diamino stilbene structure. Suitable stain reducing agents are disclosed in U.S. Pat. No 5,395,742

Suitable concentrations of stain reducing agent in the wash liquid are up to about 12 g/l preferably from about 1 to about 9 g/l.

Suitable stain reducing agents are those sold under the trade names Phorwite REU, Tinopal SFP and Uvitex MST 300. Phorwite is preferred.

Phorwite has the chemical formula:

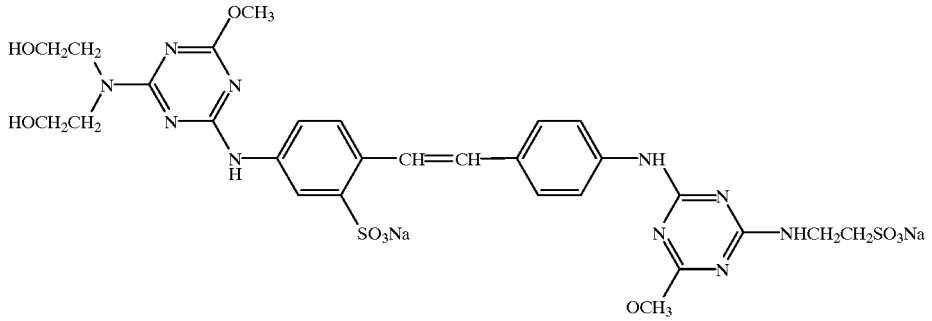

According to another aspect of the invention a photoprocessor system for the processing of photographic materials, for example film or paper comprises: a development tank (2) associated with a bleach-fix tank (4) which is associated with a first of a plurality of wash tanks (6, 8, 10 and 12) connected in series and wherein there is provided a reservoir (14) for a stain reducing agent and means (16) for supplying the stain reducing agent to the first wash tank (6).

The photoprocessor may be a small photoprocessor known in the art as a minilab. In this case it is preferred that the stain reducing agent is present in the wash liquid in the first wash tank whilst the wash liquid in the subsequent wash tanks (usually three in number as there are usually four wash tanks in total) contains no stain reducing agent apart from any carry over.

Figure 2:
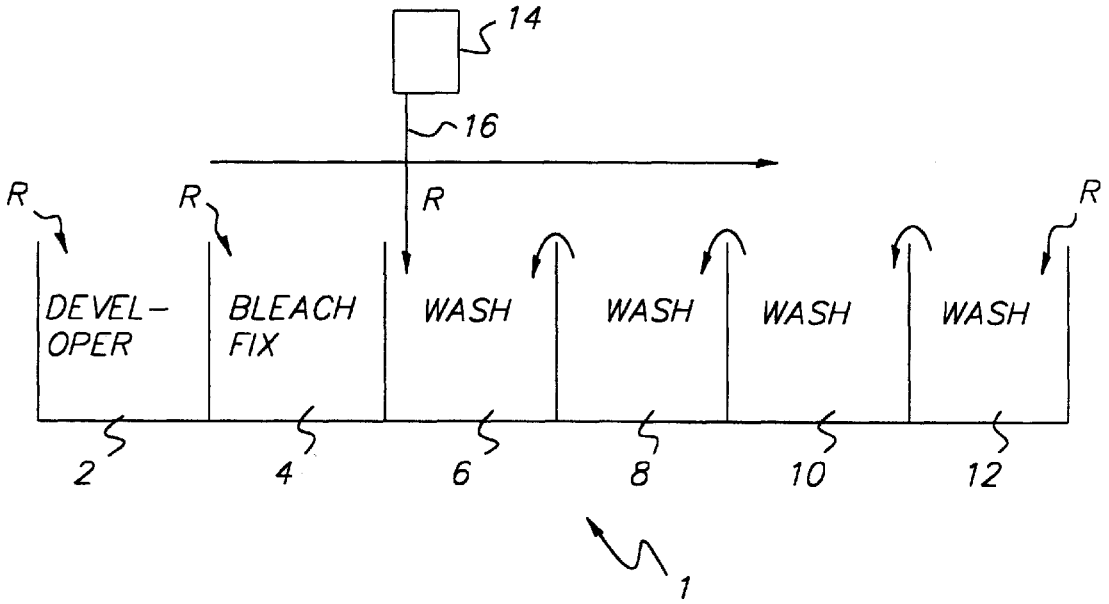
FIG. 2 shows a typical arrangement of developer, bleach-fix and wash tanks in a minilab photoprocessor system.

Referring to FIG. 2 minilab is indicated generally by reference numeral 1. Photographic paper which moves in a direction of from left to right as indicated by the arrow is passed through the developer liquid in tank 2. Tank 2 is replenished as indicated by the arrow and letter R. The paper is then passed through the bleach-fix liquid in tank 4. Tank 4 is also replenished as indicated by the arrow and letter R.

The liquid levels in tanks 2 and 4 are maintained constant by overflow (not shown).

The paper is then passed through the wash liquid in the wash tank 6 which is the first of four wash tanks 6, 8, 10 and 12.

The stain reducing agent is added to the wash liquid in tank 6 and will be replenished to maintain the concentration at the desired level in the range 2 to 12 g/l. The liquid level in tank 6 is maintained constant by replenishment indicated by the letter R and by overflow (not shown). The wash liquid in tank 12 is replenished as indicated by the letter R with water or stabiliser free of stain reducing agent and the level maintained constant by overflow into tank 10 which in turn overflows into tank 8 which overflows into tank 6. Thus the direction of the photographic paper is countercurrent to the flow of liquid in the wash tanks. Stain reducing agent on the paper as a result of passage through tank 6 is removed in the subsequent washing tanks 8, 10 and 12.

The invention is illustrated by the following Examples.

EXAMPLE 1

In this Example a short process cycle as shown in Table 1 was run in a sinkline in which the first wash tank contained either water as a comparison or Phorwite REU.

TABLE 1

| | short process cycle | Temperature |
|---|---|---|
| Develop | 15 seconds | 40° C. |
| bleach-fix | 15 seconds | 40° C. |
| first wash | 5 to 20 seconds | 37° C. |
| main wash | 15 seconds | 37° C. |

Where the developer is Kodak (Registered Trade Mark) Ektacolor SM (Registered Trade Mark) developer, bleach-fix is Kodak Ektacolor SM bleach-fix (pH 6.3). The paper used was Ektacolor Edge 7. The first wash stage included a water check and solutions of Phorwite REU at 2 g/l and 8 g/l. Phorwite REU is an optical brightener. The reference process cycle is shown in Table 2.

TABLE 2

| | long process cycle | temperature |
|---|---|---|
| develop | 45 seconds | 37.8° C. |
| bleach-fix | 45 seconds | 37.8° C. |
| wash | 90 seconds | 35° C. |

Where the developer is Kodak (Registered Trade Mark) RA-12 developer and the bleach-fix is Kodak RA-12 bleach-fix. This process gives the reference values for CIELAB stain measurements for Kodak Ektacolor (Registered Trade Mark) Edge 7 paper and these are shown in Table 3. These are the values to be aimed at for the short process cycle.

The results are in Table 3 in terms of CIELAB stain measurements L, a* and b* which were measured in all cases reported herein on a special array densitometer with a UV filter in the light source.

TABLE 3

| | | | Stain measurements | | | | |
|---|---|---|---|---|---|---|---|
| strip ref | first wash solution see Table 2 | reference | first wash time | total wash time 90 seconds | L 90.647 | a* −0.007 | b* −1.158 |
| 147-1 | Water | comparison | 5 seconds | 20 | 89.703 | 0.288 | 0.636 |
| 147-14 | REU (2 g/l) | invention | 5 | 20 | 89.73 | 0.508 | −0.697 |
| 147-13 | REU (8 g/l) | invention | 5 | 20 | 89.908 | 0.331 | −0.569 |
| 147-7 | Water | comparison | 10 | 25 | 89.861 | 0.307 | 0.505 |
| 147-15 | REU (2 g/l) | invention | 10 | 25 | 89.95 | 0.270 | −0.512 |
| 147-8 | REU (8 g/l) | invention | 10 | 25 | 90.12 | 0.188 | −1.008 |
| 147-9 | Water | comparison | 20 | 35 | 90.135 | 0.044 | −0.547 |
| 147-16 | REU (2 g/l) | invention | 20 | 35 | 90.087 | 0.194 | −1.015 |
| 147-10 | REU (8 g/l) | invention | 20 | 35 | 90.395 | 0.034 | −1.430 |

It can be seen from the data in Table 3 that the presence of Phorwite REU in the first wash tank shows that L and a* are not affected very much but they do show a small improvement towards the aim reference values. The improvement in b* is much more significant. For the higher level of Phorwite b* is better than the reference value for a much shorter wash time of 35 seconds compared with 90 seconds.

Observation of the paper strips when placed under an ultraviolet lamp (366 nm) showed a small amount of fluorescence for strips with Phorwite REU in the first wash tank that had a following 15 second wash. Strips in which the final 15 second wash was omitted showed a strong fluorescence. This indicates that some but not all the Phorwite REU is removed in the final 15 second wash.

In order to remove any retained Phorwite another experiment was run with a longer final wash of 60 seconds. The data are shown in Table 4.

TABLE 4

Long final wash

| strip ref | first wash solution see Table 2 | reference | first wash time | total wash time 90 seconds | L 90.647 | a* −0.007 | b* −1.158 |
|---|---|---|---|---|---|---|---|
| 147-3 | water | comparison | 5 seconds | 65 | 90.44 | −0.222 | −0.916 |
| 147-4 | REU (8 g/l) | invention | 5 | 65 | 90.635 | −0.192 | −1.04 |
| 147-5 | water | comparison | 10 | 70 | 90.504 | −0.2 | −0.81 |
| 147-6 | REU (8 g/l) | invention | 10 | 70 | 90.605 | −0.122 | −1.25 |
| 147-11 | water | comparison | 20 | 80 | 90.511 | −0.202 | −1.158 |
| 147-12 | REU (8 g/l) | invention | 20 | 80 | 90.701 | −0.078 | −1.829 |

It can be seen from Table 4 that even with a long final wash the presence of Phorwite REU in the first wash tank improves the stain position relative to the same tank without Phorwite. In addition the final stain is better than the reference for a total wash time of 70 seconds or more and even at 65 seconds it is very close to the reference values.

Examination of the strips under an ultraviolet lamp at 366 nm showed that there was only very slight fluorescence indicating almost no retained Phorwite in the paper.

Thus it is possible to shorten wash time and obtain a stain position as good as or better than the reference by using the principle of including Phorwite REU in the first wash tank but not in the following wash tanks. It is also possible by this method to prevent retained Phorwite REU in the coating with shorter wash times than the reference process.

This example demonstrates the first benefit of the invention in that shorter wash times are possible, with no retained Phorwite and fresh stain levels equal or better than the reference.

EXAMPLE 2

This experiment demonstrates the benefit of higher temperature washing.

In this example a relatively poor wash condition was deliberately used to check the effect of wash water temperature on the stain level in colour paper. The process cycle used was as in Table 5.

TABLE 5

| | short process cycle | temperature |
|---|---|---|
| develop | 15 seconds | 40° C. |
| bleach-fix (pH 5.4) | 15 seconds | 40° C. |
| wash | 30 seconds | 21 to 55° C. |

Where the developer is Kodak Ektacolor SM developer, bleach-fix is Kodak Ektacolor SM bleach-fix (pH 5.2). This condition with the lower pH in the bleach-fix than used in Example 1 coupled with a 30 second wash results in a worse stain position than the reference values. The paper used was Ektacolor Edge 7.

It can be seen from FIG. 1 that on average b* falls by over one unit with increase in temperature from 22 to 55° C. This is a significant improvement in the stain level in the next example temperature increase in the wash is used in combination with Phorwite REU in the first wash tank to lower retained Phorwite in the paper.

EXAMPLE 3

According to the invention.

In this example Phorwite REU was present in the first wash tank and the main wash was examined at two different temperatures as shown in the process cycle in Table 6.

TABLE 6

| | short process cycle | temperature |
|---|---|---|
| develop | 15 seconds | 40° C. |
| bleach-fix | 15 seconds | 40° C. |
| first wash | 5 to 20 seconds | 40° C. |
| main wash | 15 seconds | 37 and 56° C. |

The results are shown in Table 7.

TABLE 7

Effect of Phorwite and final wash temperature

| strip ref | First wash solution see Table 2 | wash temperature 35 | first wash time | total wash time 90 seconds | L 90.647 | a* −0.007 | b* −1.158 |
|---|---|---|---|---|---|---|---|
| 147-14 | REU (2 g/l) | 37 | 5 seconds | 20 | 89.729 | 0.509 | −0.697 |
| 147-18 | REU (2 g/l) | 56 | 5 | 20 | 90.2493 | 0.149 | −0.964 |

TABLE 7-continued

Effect of Phorwite and final wash temperature

| strip ref | First wash solution see Table 2 | wash temperature 35 | first wash time | total wash time 90 seconds | L 90.647 | a* −0.007 | b* −1.158 |
|---|---|---|---|---|---|---|---|
| 147-15 | REU (2 g/l) | 37 | 10 | 25 | 89.95 | 0.270 | −0.512 |
| 147-19 | REU (2 g/l) | 56 | 10 | 25 | 90.314 | 0.086 | −0.712 |
| 147-17 | REU (2 g/l) | 37 | 15 | 30 | 90.265 | 0.097 | −0.785 |
| 147-21 | REU (2 g/l) | 56 | 15 | 30 | 90.349 | 0.084 | −1.086 |
| 147-16 | REU (2 g/l) | 37 | 20 | 35 | 90.087 | 0.194 | −1.015 |
| 147-20 | REU (2 g/l) | 56 | 20 | 35 | 90.309 | 0.076 | −1.162 |

The data in Table 7 shows that the values of L, a* and b* are closer to the reference values for the final wash with the higher temperature. In addition by viewing the strips under an ultraviolet lamp at 366 nm it was clear that there was some fluorescence for the low temperature wash particularly at short wash times but there was almost no fluorescence for any of the wash times for the higher temperature wash. These data indicate that a higher wash temperature lowers stain and in addition prevents retention of Phorwite REU in the paper.

EXAMPLE 4

According to the invention.

It has been found that if paper strips processed with short wash times are left stacked together for a period of time a room temperature, largely without any incident light, the stain level can increase. This is particularly noticeable in the b* value and corresponds to an increase in yellow stain. Some strips (processed by the methods described in this report) were re-measured after standing for 4 weeks at room temperature. (22° C.). Some results are shown in Table 8.

TABLE 8

Strips re-measured after 4 weeks

| Strip | first wash solution | | first wash time | total wash time | L | a* | b* |
|---|---|---|---|---|---|---|---|
| 147-1 | water | comparison | 5 seconds | 20 seconds | 89.703 | 0.288 | 0.636 |
| 147-1b | water | re-measured | 5 seconds | 20 | 89.396 | −0.017 | 3.468 |
| 147-14 | REU (2 g/l) | invention | 5 | 20 | 89.73 | 0.508 | −0.697 |
| 147-14b | REU (2 g/l) | re-measured | 5 | 20 | 89.565 | 0.188 | 1.339 |
| 147-13 | REU (8 g/l) | invention | 5 | 20 | 89.908 | 0.331 | −0.569 |
| 147-13b | REU (8 g/l) | re-measured | 5 | 20 | 89.786 | 0.042 | 1.453 |
| 147-7 | water | comparison | 10 | 25 | 89.861 | 0.307 | 0.505 |
| 147-7b | water | re-measured | | | 89.691 | 0.247 | 1.828 |
| 147-15 | REU (2 g/l) | invention | 10 | 25 | 89.95 | 0.270 | −0.512 |
| 147-15b | REU (2 g/l) | re-measured | 10 | 25 | 89.844 | 0.202 | 0.388 |
| 147-8 | REU (8 g/l) | invention | 10 | 25 | 90.12 | 0.188 | −1.008 |
| 147-8b | REU (8 g/l) | re-measured | 10 | 25 | 90.05 | 0.101 | −0.048 |
| 147-9 | water | comparison | 20 | 35 | 90.135 | 0.044 | −0.547 |
| 147-9b | water | re-measured | 20 | 35 | 90.04 | −0.091 | 0.524 |
| 147-16 | REU (2 g/l) | invention | 20 | 35 | 90.087 | 0.194 | −1.015 |
| 147-16b | REU (2 g/l) | re-measured | 20 | 35 | 90.212 | 0.124 | −0.404 |
| 147-10 | REU (8 g/l) | invention | 20 | 35 | 90.395 | 0.034 | −1.430 |
| 147-10b | REU (8 g/l) | re-measured | 20 | 35 | 90.385 | 0.049 | −0.909 |

The values of L, a* and b* are very close to the reference values and thus the method described in the invention in which Phorwite REU is present only in the first wash tank followed by a main wash which does not contain Phorwite REU but is run at a higher temperature can give low stain levels even for very short wash times.

This example demonstrates the second benefit of the invention whereby even shorter wash times than those already demonstrated in example 1 are possible with stain levels as good as the reference.

The data in Table 8 show that after keeping for 4 weeks stain levels have increased for all strips. In all cases the stain for the water comparison increases more than the Phorwite example.

This shows the third benefit of the invention in that stain increases on keeping after short wash times are less if Phorwite REU is present in the first wash tank. It is desired however to employ the method of the invention and to further lower the stain increase on keeping and this is shown in the next example.

EXAMPLE 5

According to the invention.

If the final wash is extended as in the example described in table 3, the general stain increase on keeping can be lowered irrespective of the method. The data are shown in Table 9.

TABLE 9

Strips re-measured after 4 weeks (long final wash)

| Strip | first wash solution | | first wash time | total wash time | L | a* | b* |
|---|---|---|---|---|---|---|---|
| 147-3 | water | comparison | 5 seconds | 65 | 90.44 | −0.222 | −0.916 |
| 147-3b | water | re-measured | 5 | 65 | 90.44 | −0.196 | −0.529 |
| 147-4 | REU (8 g/l) | invention | 5 | 65 | 90.635 | −0.192 | −1.04 |
| 147-4b | REU (8 g/l) | re-measured | 5 | 65 | 90.641 | −0.150 | −0.762 |
| 147-5 | water | comparison | 10 | 70 | 90.504 | −0.2 | −0.81 |
| 147-5b | water | re-measured | 10 | 70 | 90.479 | −0.160 | −0.444 |
| 147-6 | REU (8 g/l) | invention | 10 | 70 | 90.605 | −0.122 | −1.25 |
| 147-6b | REU (8 g/l) | re-measured | 10 | 70 | 90.626 | −0.010 | −1.101 |
| 147-11 | water | comparison | 20 | 80 | 90.511 | −0.202 | −1.158 |
| 147-11b | water | re-measured | 20 | 80 | 90.529 | −0.129 | −0.997 |
| 147-12 | REU (8 g/l) | invention | 20 | 80 | 90.701 | −0.078 | −1.829 |
| 147-12b | REU (8 g/l) | re-measured | 20 | 80 | 90.759 | −0.063 | −1.735 |

The data in Table 9 show unexpectedly thst even with longer wash times compared with those shown in example 1 the benefit of Phorwite in the first was tank is still demonstrated. The stain increases on keeping is less for the Phorwite examples and is minimal at the longer times. Thus although these wash times are longer than desired they are still shorter than those used in the reference process.

This shows the fourth benefit of the invention in that shorter wash times than the reference can be achieved, with no retained Phorwite REU and with minimal stain increase on keeping.

It is however desired to shorten the wash times even more than in the above example. This is shown in the next example.

EXAMPLE 6

According to the invention.

In this example the use of Phorwite in the first wash tank is combined with a following wash at higher temperature (56° C.). The results are shown in Table 10. The strip numbers with the b suffix are the re-measured strips.

The b suffix means the strips were re-measured after 4 weeks.

TABLE 10

Effect of Phorwite and final wash temperature re-measured strips

| strip | first wash solution | wash temperature | first wash time | total wash time | L | a* | b* |
|---|---|---|---|---|---|---|---|
| 147-14 | REU (2 g/l) | 37 | 5 seconds | 20 | 89.729 | 0.509 | −0.697 |
| 147-14b | " | 37 | 5 | 20 | 89.568 | 0.188 | 1.339 |
| 147-18 | REU (2 g/l) | 56 | 5 | 20 | 90.2493 | 0.149 | −0.964 |
| 147-18b | " | 56 | 5 | 20 | 90.215 | 0.095 | −0.446 |
| 147-15 | REU (2 g/l) | 37 | 10 | 25 | 89.95 | 0.270 | −0.512 |
| 137-15b | " | 37 | 10 | 25 | 89.844 | 0.202 | 0.389 |
| 147-19 | REU (2 g/l) | 56 | 10 | 25 | 90.314 | 0.086 | −0.712 |
| 147-19b | " | 56 | 10 | 25 | 90.326 | 0.086 | −0.331 |
| 147-17 | REU (2 g/l) | 37 | 15 | 30 | 90.265 | 0.097 | −0.785 |
| 147-17b | " | 37 | 15 | 30 | 90.053 | 0.179 | −0.470 |
| 147-21 | REU (2 g/l) | 56 | 15 | 30 | 90.349 | 0.084 | −1.086 |
| 147 21b | " | 56 | 15 | 30 | 90.38 | 0.206 | −0.956 |
| 147-16 | REU (2 g/l) | 37 | 20 | 35 | 90.087 | 0.194 | −1.015 |
| 147-16b | " | 37 | 20 | 35 | 90.212 | 0.124 | −0.404 |
| 147-20 | REU (2 g/l) | 56 | 20 | 35 | 90.309 | 0.076 | −1.162 |
| 147-20b | " | 56 | 20 | 35 | 90.343 | 0.097 | −0.996 |

It can be seen from Table 10 that the higher temperature final wash has better fresh stain values and also lower stain increase after keeping. The stain values for 30 seconds or more total wash are now very close to the reference values and show almost no increase on keeping. An examination of the strips under an ultraviolet lamp at 366 nm shows almost no fluorescence for the higher temperature cases even at short wash times. This shows that Phorwite REU is not retained in the paper.

This demonstrates the fifth benefit of the invention in that very short wash times are possible with low fresh stain, no retained Phorwite REU and minimal increase in stain on keeping.

EXAMPLE 1a

Two other stain reducing agents were compared with Phorwite REU. These were Tinopal SFP and Uvitex MST 300.

These stain reducing agents were dissolved in the first wash at 0, 2 and 8 g/l in tap water.

The paper was Ektacolor Edge 7. This paper was about 6 months older than when used for the original experiments with Phorwite REU so the basic stain level was expected to be higher.

TABLE 1a

| process cycle | | Temperature |
|---|---|---|
| develop | 14 sec | 40° C. |
| blix | 14 sec | 40° C. |
| first wash | 5, 10, 15 sec | 40° C. |

TABLE 1a-continued

| process cycle | | Temperature |
|---|---|---|
| final wash | 15 sec | 36° C. |
| dry | in air | |

Where the developer is Ektacolor SM tank developer, and the blix is Ektacolor SM tank bleach-fix The blix was adjusted to pH of 6.2 before use.

The results are shown in Table 2a are for 2 g/l stain reducing agent and in 3a for 8 g/l stain reducer. In these experiments the first wash was 5, 10 or 15 seconds.

The final wash was always 15 seconds. Water was used as the check for the first wash in each case.

The data shown in Table. 2a show the CIELAB measurements (L, a* and b*)and the red, green and blue (RGB) Dmin density measurements with and without a UV filter in the light source. A consistent pattern is clear in that Phorwite lowers b* and B Dmin more than other materials although all the stain reducers show an improvement over the water check.

The data in Table 3a are similar to those in Table 2a except that the effects are greater for the higher level of stain reducer. Phorwite REU consistently has lower b* and B Dmin values with and without a UV filter than the other stain reducers although all of them show an improvement over the water check.

TABLE 2a

Comparison of stain reducers in first wash (2 g/l)

| | | | | | u.v filter D min × 1000 | | | no u.v filter Dmin × 1000 | | |
|---|---|---|---|---|---|---|---|---|---|---|
| first wash | time | L | a* | b* | R | G | B | R | G | B |
| water | 5 | 90.67 | −1.25 | 0.46 | 110 | 102 | 111 | 95 | 93 | 91 |
| Tinopat (2 g/l) | 5 | 90.62 | −1.27 | 0.78 | 109 | 104 | 113 | 94 | 94 | 88 |
| Uvitex (2 g/l) | 5 | 90.60 | −1.33 | 0.64 | 111 | 104 | 114 | 93 | 94 | 91 |
| Phorwite (2 g/l) | 5 | 90.43 | −1.13 | 0.02 | 112 | 105 | 110 | 97 | 96 | 88 |
| water | 10 | 90.63 | −1.25 | 0.42 | 110 | 104 | 111 | 92 | 93 | 90 |
| Tinopat (2 g/l) | 10 | 90.78 | −1.16 | 0.54 | 107 | 102 | 108 | 90 | 91 | 81 |
| Uvitex (2 g/l) | 10 | 90.62 | −1.28 | 0.11 | 110 | 103 | 108 | 93 | 93 | 83 |
| Phorwite (2 g/l) | 10 | 90.62 | −1.10 | −0.4 | 110 | 104 | 103 | 95 | 94 | 80 |
| water | 15 | 90.72 | −1.10 | 0.05 | 108 | 102 | 107 | 92 | 92 | 88 |
| Tinopal (2 g/l) | 15 | 90.66 | −1.09 | 0.04 | 108 | 103 | 104 | 94 | 04 | 76 |
| Uvitex (2 g/l) | 15 | 90.77 | −1.15 | 0.16 | 108 | 101 | 106 | 91 | 90 | 78 |
| Phorwite (2 g/l) | 15 | 90.76 | −1.01 | −0.4 | 108 | 102 | 101 | 93 | 94 | 77 |

TABLE 3a

Comparison of stain reducers in first wash

| | | | | | u.v filter D min × 1000 | | | no u.v filter Dmin × 1000 | | |
|---|---|---|---|---|---|---|---|---|---|---|
| first wash | time | L | a* | b* | R | G | B | R | G | B |
| water | 5 | 90.67 | −1.25 | 0.46 | 110 | 102 | 111 | 95 | 93 | 91 |
| Tinopal (8 g/l) | 5 | 90.54 | −0.76 | 1.06 | 106 | 106 | 113 | 89 | 98 | 86 |
| Uvitex (8 g/l) | 5 | 90.56 | −1.27 | 0.68 | 111 | 104 | 113 | 94 | 94 | 86 |
| Phorwite (8 g/l) | 5 | 90.65 | −1.18 | 0.15 | 110 | 103 | 106 | 94 | 95 | 81 |
| water | 10 | 90.63 | −1.25 | 0.42 | 110 | 104 | 111 | 92 | 93 | 90 |
| Tinopal (8 g/l) | 10 | 90.6 | −1.94 | 0.37 | 108 | 104 | 106 | 92 | 93 | 73 |
| Uvitex (8 g/l) | 10 | 90.52 | −1.22 | 0.03 | 111 | 104 | 108 | 94 | 95 | 78 |
| Phorwite (8 g/l) | 10 | 90.71 | −0.98 | −0.3 | 108 | 103 | 102 | 93 | 94 | 74 |
| water | 15 | 90.72 | −1.10 | 0.05 | 108 | 102 | 107 | 92 | 92 | 88 |
| Tinopal (8 g/l) | 15 | 90.65 | −0.99 | 0.00 | 108 | 103 | 104 | 93 | 94 | 70 |
| Uvitex (8 g/l) | 15 | 90.66 | −1.12 | −0.03 | 109 | 103 | 106 | 92 | 93 | 73 |
| Phorwite (8 g/l) | 15 | 90.69 | −0.85 | −0.77 | 109 | 103 | 97 | 92 | 93 | 67 |

EXAMPLE 2a

In this example the effect of the stain reducers on Dmax is examined and also the ease with which they wash out of the coating. The strips were processed in the standard Ektacolor SM process and dried. They were then measured for B Dmax (1), immersed in a solution of water or the stain reducing agent at 2 g/l for 15 seconds, dried measured for B Dmax (2) and then washed for 15 seconds, dried, measured for B Dmax(3).

TABLE 4a

Effect of stain reducers (2 g/l) on blue Dmax.

| compound | B Dmax1 | B Dmax2 | B Dmax3 |
|---|---|---|---|
| water | 2.14 | 2.14 | 2.14 |
| Tinopal (2 g/l) | 2.14 | 1.99 | 2.03 |
| Uvitex (2 g/l) | 2.13 | 2.00 | 2.05 |
| Phorwite (2 g/l) | 2.14 | 2.06 | 2.11 |

It can be seen that after treatment with the stain reducers there is a loss of B Dmax which is caused by the fluorescence of retained stain reducer, thus it is desired to minimise the loss of B Dmax but also to maximise the improvement in B dmin also caused by the stain reducer. In the case of some stain reducers, particularly Phorwite REU, the improvement in B Dmin is only partly caused by (a) fluorescence but also mainly by (b) assisting the removal of retained sensitising dye. Thus an improvement in B Dmin should be obtainable by mechanism (b) by the method of the invention, this appears to be the case from the data shown above. In Table 4a the loss in B Dmax (2) is less for Phorwite than the others. In addition the restoration of B Dmax (3) after a I5 second wash is better with Phorwite than the others. In all Phorwite shows only a 0.03 loss of B Dmax whereas the others show 0.08 (Uvitex) and 0.11 (Tinopal). The data combined with that from Tables 2a and 3a in which Phorwite shows a significant improvement in B Dmin demonstrates the invention.

The same experiment was repeated with 8 g/l of stain reducer.

TABLE 5a

Effect of stain reducers (8 g/l) on blue Dmax

| compound | B Dmax1 | B Dmax2 | B Dmax3 |
|---|---|---|---|
| water | 2.13 | 2.13 | 2.13 |
| Tinopal (8 g/l) | 2.14 | 1.84 | 1.96 |
| Uvitex (8 g/l) | 2.13 | 1.92 | 2.00 |
| Phorwite (8 g/l) | 2.14 | 1.94 | 2.06 |

Phorwite shows only a 0.08 loss of B Dmax whereas Uvitex shows 0.13 and Tinopal 0.18.

Thus the method of the invention is demonstrated in that a reduction in blue Dmin density is obtainable by the inclusion of a stain reducer in the first wash followed by a completion of the wash without stain reducer. In addition the loss in blue Dmax caused by the retention of the stain reducer is minimised. This combination of desired results can be highlighted by the ratio of the blue Dmax to the blue Dmin as shown in Table 6a.

TABLE 6a ratio of B Dmax/B Dmin

| compound | Dmax/Dmin (2 g/l) | Dmax/Dmin (8 g/l) |
|---|---|---|
| water | 24.2 | 24.2 |
| Tinopal | 26.7 | 28.0 |
| Uvitex | 26.3 | 27.3 |
| Phorwite | 27.4 | 30.7 |

Here it can be seen that all the stain reducers are beneficial in the first wash compared with water which demonstrates the principal of the invention but also that Phorwite REU is better than the other two.

What is claimed is:

1. A process for the processing of an imagewise exposed photographic material which has been subjected to development and bleach-fixing which process comprises a plurality of sequential washing steps and where a stain reducing agent is employed wherein the photographic material is contacted with an effective amount of the stain reducing agent in the wash liquid in a first washing step and the photographic material is subjected to a following washing step to remove the stain reducing agent.

2. A process as claimed in claim 1 employing a plurality of wash tanks in which the developed material is washed sequentially and wherein the stain reducing agent is present in the wash liquid in a first wash tank and removed from the photographic material by the wash liquid in one or more following wash tanks.

3. A process as claimed in claim 1 wherein the temperature of wash liquids is within the range 40 to 70° C.

4. A process as claimed in claim 1 wherein the photographic material is subjected to a following washing step to remove the stain reducing agent, the process being a rapid process employing a plurality of washing steps and in which the durations of the individual washing steps are not greater than 30 seconds.

5. A process as claimed in claim 1, wherein the stain reducing agent is one containing a diamino stilbene structure.

6. A process as claimed in claim 1, wherein the concentration of stain reducing agent in the wash liquid to which it is added is up to 12 g/l.

7. A process as claimed in claim 5, wherein the concentration of stain reducing agent in the wash liquid to which it is added is from 1.5 to 9 g/l.

* * * * *